United States Patent [19]

Chilva

[11] Patent Number: 4,767,321

[45] Date of Patent: Aug. 30, 1988

[54] OVEN FOR HEATING AND STACKING THERMOPLASTIC FIBER REINFORCED RESIN SHEETS

[75] Inventor: Timothy E. Chilva, Utica, Mich.

[73] Assignee: Azdel, Inc., Shelby, N.C.

[21] Appl. No.: 58,720

[22] Filed: Jun. 5, 1987

Related U.S. Application Data

[62] Division of Ser. No. 937,798, Dec. 4, 1986, abandoned.

[51] Int. Cl.[4] ..... F27B 9/28

[52] U.S. Cl. ..... 432/59; 432/8; 414/41; 34/208

[58] Field of Search ..... 432/8,6,59; 34/208; 414/147,157,41

[56] References Cited

U.S. PATENT DOCUMENTS

| | | | |
|---|---|---|---|
| Re. 30,266 | 5/1980 | Greene et al. | 34/86 |
| 1,736,980 | 11/1929 | Pauzireff | 34/208 |
| 3,787,171 | 1/1974 | Cromp | 432/72 |
| 3,874,091 | 4/1975 | Fukumoto | 432/146 |
| 4,042,125 | 8/1977 | Falkinger et al. | 414/41 |
| 4,316,758 | 2/1982 | Suzuki et al. | 414/41 |
| 4,493,640 | 1/1985 | Hanson | 432/72 |
| 4,568,274 | 2/1986 | Imose et al. | 432/59 |
| 4,588,378 | 5/1986 | Yamamoto et al. | 432/59 |
| 4,591,336 | 5/1986 | Konczalski | 432/59 |
| 4,591,517 | 5/1986 | Whipple et al. | 432/8 |

*Primary Examiner*—Henry C. Yuen

*Attorney, Agent, or Firm*—John E. Curley

[57] ABSTRACT

A method and apparatus for heating fibers reinforced thermoplastic sheets is disclosed. The apparatus involves use of gas heating ovens adapted to allow several layers of material to be heated continuously, with the conveyors stacked are above the other. Stacking of the heated product can be provided at the oven exit. Provisions for cleaning and diffusing the gases over the work piece are also described.

2 Claims, 3 Drawing Sheets

OVEN FOR HEATING AND STACKING THERMOPLASTIC FIBER REINFORCED RESIN SHEETS

This is a division of application Ser. No. 937,798, filed Dec. 4, 1986, now abandoned.

The present invention relates to the heating of fiber reinforced thermoplastic sheets for subsequent molding. More particularly, the present invention relates to a method and apparatus suitable for use in preparing fiber reinforced thermoplastic sheets for molding or stamping. Still more particularly, the present invention relates to a method and apparatus suitable for use in preparing fiber reinforced thermoplastic sheets for subsequent molding in which several heated sheets are stacked after heating, one on top of the other prior to molding.

BACKGROUND OF THE INVENTION

In U.S. Pat. Nos. 3,626,053 and 3,621,092, processes are described for molding fiberglass reinforced thermoplastic sheets utilizing presses. In the processes described in both patents, a reinforcing mat, typically formed of glass fibers, is utilized to reinforce thermoplastic resin in sheet form. The mat reinforced sheets are then stamped into shaped parts utilizing a press. Prior to placing the sheets in the press for stamping into shaped parts, however, the sheets must be heated to a temperature sufficient to render the resin of the sheet molten or flowable while maintaining the temperature of the sheet below the decomposition temperatures of the thermoplastic resin used to prepare the sheet. The heating systems described in both of these patents involve infrared ovens.

Various other patents have issued which relate to fiber reinforced thermoplastic sheet products such as those described in the aforementioned patents. Exemplary of some of these other patents are U.S. Pat. Nos. 3,664,909, 3,684,645 and 4,335,176. In all of these patents the product described is suitable for use in stamping or compression molding operation. In utilizing any of the fiber reinforced thermoplastic products described in these patents, the fiber reinforced thermoplastic resin sheet product is first heated to bring it to a temperature sufficient to render the resin component of the sheet flowable or molten. The heated sheet, while the resin is still in the flowable state, is then placed on a mold in a suitable press such as a hydraulic or mechanical press and pressure is applied to stamp or mold the sheet into a shaped part. As described in the aforementioned patents, rendering the resin molten prior to molding the fiber reinforced sheet, permits the resin to flow during molding and the reinforcement flows with the resin. This provides a shaped part which has reinforcement uniformly distributed throughout.

In preparing the reinforced thermoplastic resin sheets for the compression molding processes utilized in the art, recourse has been had to the utilization of infrared ovens for the heating of the sheets. It has also been common practice to employ an oven containing a standard cable conveyor system which oven is provided with opposing infrared heaters on the top and the bottom of the oven facing each other. The sheets are placed on the cable conveyor and moved through the oven or held there in a stationary position while heat is applied from the infrared heaters to render the resin contained in the reinforced resin sheets molten. Once the resin is molten the sheets containing the molten resin can then be placed on a cold mold in a hydraulic press. The press is closed quickly to provide for the reinforcement and resin to flow and fill the mold. The resin cools and solidifies as the part is stamped or molded resulting in a shaped product.

While infrared heating of fiber reinforced thermoplastic blanks or sheets has been the rule in industry to date, such heating does present certain disadvantages with respect to providing an efficient process. Infrared ovens are by nature, in the environment utilized to heat thermoplastic resin sheets, inefficient. In the heating of fiber reinforced thermoplastic sheets it has been found in practice that the reflectors or heaters become quite dirty due to the release of dust into the atmosphere usually from the edges of the reinforced thermoplastic resin sheets passed through the ovens. This dust which settles on the reflectors contaminating their surfaces require substantial percentage increases in the power fed to the heaters over time to compensate for losses in efficiency caused by this surface contamination. Increased heating of the infrared heaters also has the disadvantage of requiring excessive amounts of power to be utilized in heating a given sized sheet thereby increasing the cost of the production process. Further, by utilizing the infrared heaters at high energy levels continuously, the life of the heaters is substantially reduced.

In systems using black faced (infrared) heating elements positioned in ceramics, the same problem exists due to environmental contamination occurring on the ceramic surfaces. Again, increased power is required to overcome the loss of efficiency created by the deposition of a foreign material on the surface of the ceramic. Another disadvantage of the infrared system is the operational preferences attributable to individual operators in staging the heating of sheets passing through such ovens. Thus, it is common practice in the heating of thermoplastic resin blanks reinforced with fibers to pass them through the infrared oven in stages. The first stage causes considerable swelling of the sheets since most of them are reinforced with mats which have been compressed during the formation of the sheet itself. These mats have a tendency to swell the sheet once the resin reaches a flowable state during the heating operation, because the compressive forces in the mat are released once the sheet resin is no longer a rigid solid.

Thus, the sheets generally accept large quantities of heat at the inception of their passage through the ovens in the presence of infrared heaters operating at temperatures sufficient to cause the resin to melt. The sheet then, after swelling, is subjected to less severe temperature regimes but must soak in some heat in order to insure that the center of the blank receives sufficient heat to cause all of the resin in the blank to become flowable. It is in these latter stages of the heating, as the sheet passes through the oven and is subjected to stops that operators make the ultimate decision on how much power to input to that section of the oven. If too much heating occurs in these latter stages, the resin itself can deteriorate.

Finally, it is a further disadvantage of infrared ovens that the ovens with opposing infrared heaters (top and bottom) transferring heat from their surfaces to the upper and lower surfaces of a sheet moving on cable conveyors through heating ovens, are incapable of heating several layers of sheets passing through on multiple conveyors positioned one above the other, in the same oven. In any such arrangement, the bottom heaters would be prevented from heating the bottom surface of an upper row of sheets passing through a conveyor located immediately below them. This seriously limits oven capacity to two banks of heaters, one on the top and one on the bottom and a single conveyor passing through the oven so that only the sheets on one conveyor can be treated at one time.

Thus a need exists to improve the heating cycle for fiber reinforced thermoplastic sheet materials that are to be utilized in compression molding systems where heated sheets are placed in a cold mold and pressure is applied to shape those sheets into a formed part.

OBJECTS OF THE INVENTION

It is an object of the present invention to provide a process which overcomes the deficiencies of the prior art infrared heating ovens used to treat fiber reinforced thermoplastic sheets.

It is a further object of the present invention to provide a heating oven for heating fiber reinforced thermoplastic resin sheets utilizing hot circulating gas.

It is still a further object of the present invention to provide a heating oven for fiber reinforced thermoplastic resin sheets which will lend itself to the utilization of several moving conveyors within a single heating oven.

It is still a further object of the present invention to provide a method for preparing fiber reinforced thermoplastic resin sheets for subsequent molding in a hot air oven in which the sheets can be automatically stacked as they exit the oven.

It is still a further object of the invention to provide a method for preparing sheets of fiber reinforced thermoplastic resin in a heating oven in such a manner that all sheets contained within the oven are of uniform temperature.

These and other objects of the invention will be apparent from the ensuing descriptions of the preferred embodiments of the ovens and methods utilized to produce the results.

SUMMARY OF THE INVENTION

In accordance with the invention, a method is provided for preparing sheets of fiber reinforced thermoplastic resins in which the sheets are passed through an oven on a continuous basis on a conveyor system which constantly circulates through the oven. Hot gases, preferably air, although any gas inert to the resin sheets treated may be used, are passed around the sheets contained on the conveyor on all surfaces thereof at temperatures in excess of the melting temperature of the resin utilized in the sheet. The circulation rate of the hot gas is maintained preferably at below 1000 cubic feet per minute and a residence time is provided for the sheet in the oven sufficient to permit the resin to become molten or flowable throughout the sheet.

In another aspect of the invention, an oven is provided for heating these fiber reinforced resin sheets which involves a heating chamber and at least two conveyors in the chamber positioned one above the other. The lower of the conveyors used traverses the oven from one end to the other. The conveyor above the lower conveyor, in the preferred embodiment, terminates short of one end of the chamber and is provided with a sloped plane at the end thereof to thereby urge sheets on its surface in a downward direction at the end of that conveyor to the surface of the lower conveyor. Means are provided to circulate gas to all surfaces of the conveyors and to heat all sheets carried by the multiple conveyors to a desired temperature. Means are also provided to recirculate and reheat the gases continuously while the sheets are conveyed throughout the oven.

In another aspect of the invention, means are provided within the ovens contemplated to constantly clean the gas circulating therein to remove all foreign debris present in the atmosphere. The particulars of the apparatus and the methods herein provided will be made clearer in the ensuing description of the drawings and the preferred embodiments.

BRIEF DESCRIPTION OF THE DRAWINGS

For a more complete understanding of the present invention, reference is made to the accompanying drawings in which.

DETAILED DESCRIPTION OF THE DRAWINGS

Figure 1:
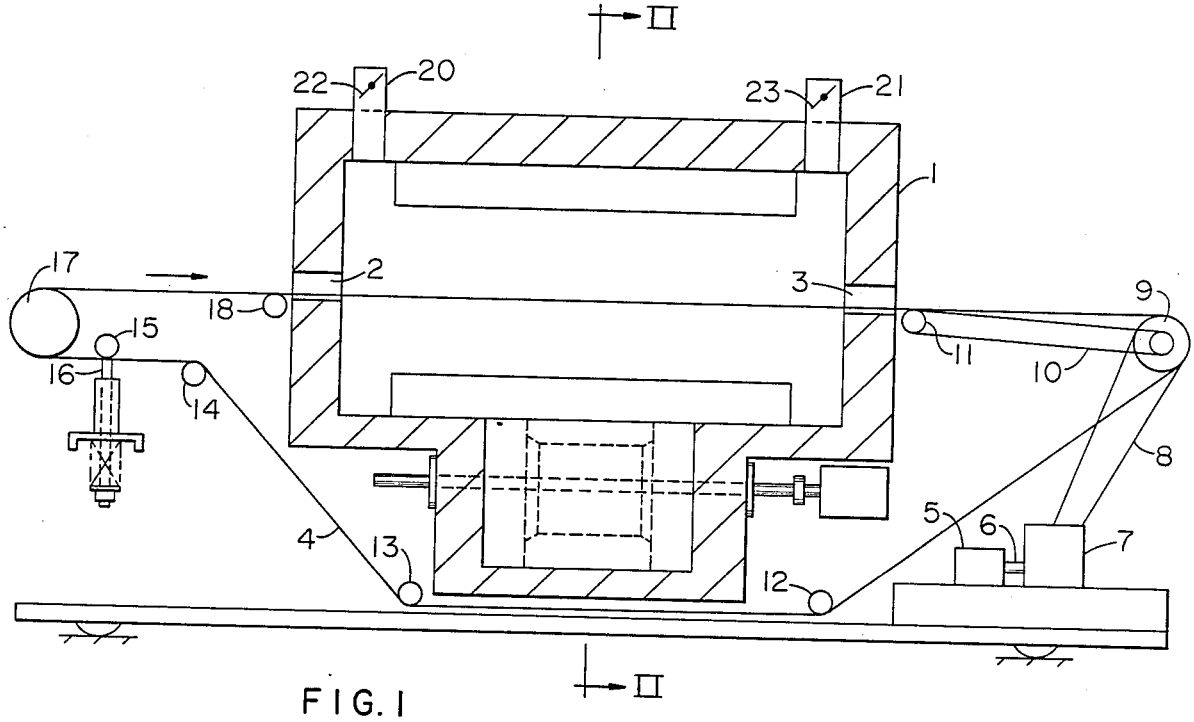
FIG. 1 is a side elevation of one embodiment of the instant invention showing the conveyor system and oven of the instant invention.
Figure 2:
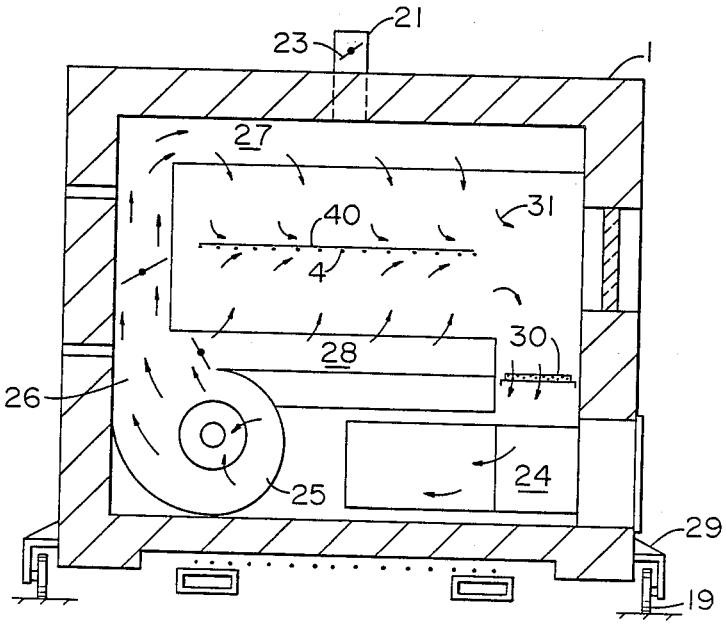
FIG. 2 is a front elevation of the oven of FIG. 1 taken through lines 2—2 of FIG. 1.

Turning now to the drawings and FIGS. 1 and 2 in particular, there is shown an oven generally indicated at 1 having at one end an entrance port 2 and at the other end an exit port 3. Traversing the oven is a conveyor 4 which is constructed of a series of cables shown in more detail in FIG. 2. Conveyor 4 is driven through motor 5 which is mounted on a mounting pad 40 and is provided with a shaft 6 which rotates a pulley in the housing 7 that rotates belt 8 off of pulley 9 which is a double track pulley having a track for the belt 8 and a separate track for belt 10 which passes around idler roll 11 contacting the under surface of the plurality of cables making up conveyor 4. The belt 4 is threaded around idler 11 and pulley 9, rollers 12, 13 and 14 and passes through the underside of roller 15 which is biased in a downward direction by shaft 16 to which it is attached. The roller 15 in conjunction with shaft 16 applies pressure to the belt 4 to maintain tension at a desired level. The cable conveyors 4 then pass around idler roll 17 over roller 18 and at that point re-enter the oven through port 2. The oven is provided with two stacks, 20 and 21, for the removal of hot gases at whatever rate is desired. Each stack is provided with an appropriate damper 22 and 23 for stacks 20 and 21, respectively. As seen more clearly in FIG. 2, the oven is also provided with an electrical heating element generally indicated at 24. The heating element is positioned behind a blower 25 and the blower introduces air in an upward direction from plenum 26 to an upper chamber or duct 27 and a lower chamber or duct 28. The chambers 27 and 28 are provided with grills so that air can be introduced above and below the conveyor 4 and in that manner provide gas to the upper and lower surfaces of sheets 60 which are transported by the conveyors 4 through the oven.

Fiber reinforced thermoplastic sheets as used herein means thermoplastic sheets reinforced with inorganic or organic fibers in fibers, mat or fabric form. Fiber glass is the preferred fiber and continuous strand mat is the preferred form for the fiber glass embodiment.

In the operation of the oven as shown in FIGS. 1 and 2, the fiber reinforced thermoplastic resin sheets to be heated are placed on the conveyor 4 and passed into the oven 1 through port 2. During their passage through the oven, hot gas is introduced from a blower 25 into plenum 26 and passes in the bifurcated upper and lower chambers 27 and 28 into the oven and around the sheets 60 on all sides. The sheets 60 are thus uniformly heated on the top and bottom and the gas temperature in the oven passing through as indicated by the arrows 31 shown in FIG. 2 is maintained at a uniform temperature. The gas after heating the sheets is then passed downwardly through the filter 30 and across the heating element 24 to raise its temperature to the desired amount prior to introducing it into blower 25 for recirculation to the furnace.

The conveyor 4 is regulated in its travel speed so that it maintains a residence time for the sheet in the oven sufficient to render the resin contained within the sheets 60 completely molten throughout the sheet. This can be determined by the thickness of the sheet, the extent and rate of travel of the sheet and the absorption capabilities of the particular resin sheet being fed. Experience will dictate the quantity of time required to take a sheet in a given high temperature atmosphere of heated gas to the requisite molten state. It is an important consideration in dealing with sheets of this character that the center of the sheet contain molten or flowable resin and for this reason, it is important to ensure that this state is reached. With the gas circulating at a uniform rate at the top, bottom and sides of the sheets as they pass through the oven, the sheets can be easily raised to the requisite temperature and maintained at that state for the necessary period of time to ensure the resin in the sheet is completely molten.

The gas utilized in the chamber is circulated at a low rate, generally below 1,000 cubic feet per minute. Preferably a rate of 100 to 750 cubic feet per minute is employed but any circulation rate of gas coupled with temperature of the gas and residence time of sheets in the oven that produce a molten or flowable resin in the sheet will suffice. The gas leaving the chamber is preferably fed through the filter and recirculated so that it can be purged of any foreign material entering the atmosphere through the edges of the sheets which normally have been cut to given sizes in preparation for molding. Thus, the sheets utilized in oven are generally speaking, of various precise dimensions required by the customer for insertion into the cold mold of the stamping press that will be utilized to shape the final part. The edges of the sheets, therefore, where the sheets have been cut to provide these requisite sizes have a tendency to shed some fiber. For this reason, the atmosphere in the circulating oven can become contaminated as it has been in the past utilizing infrared heaters and thus, must be purified. In the Applicants' system, this involves positively circulating the air in the chamber through the filter 30 prior to reheating it for passage into the blower. Removing the debris at this point also provides an air entering the reheating system that is devoid of debris and therefore, allows the heater 24 to operate at a more efficient level.

Figure 3:
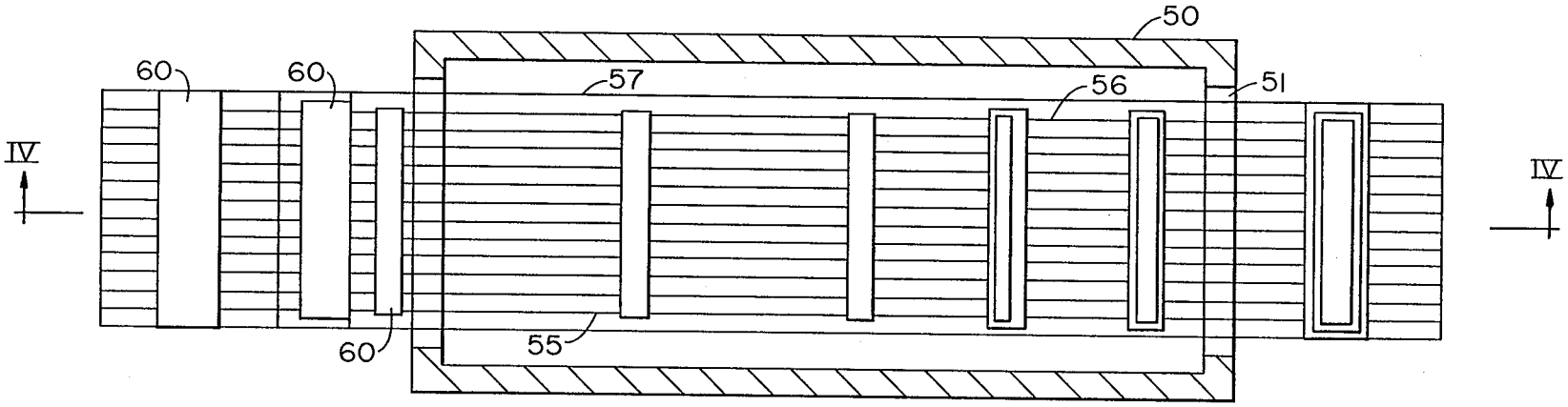
FIG. 3 is a plan view of a second embodiment of the instant invention where the oven utilized encompasses multiple conveyors.
Figure 4:
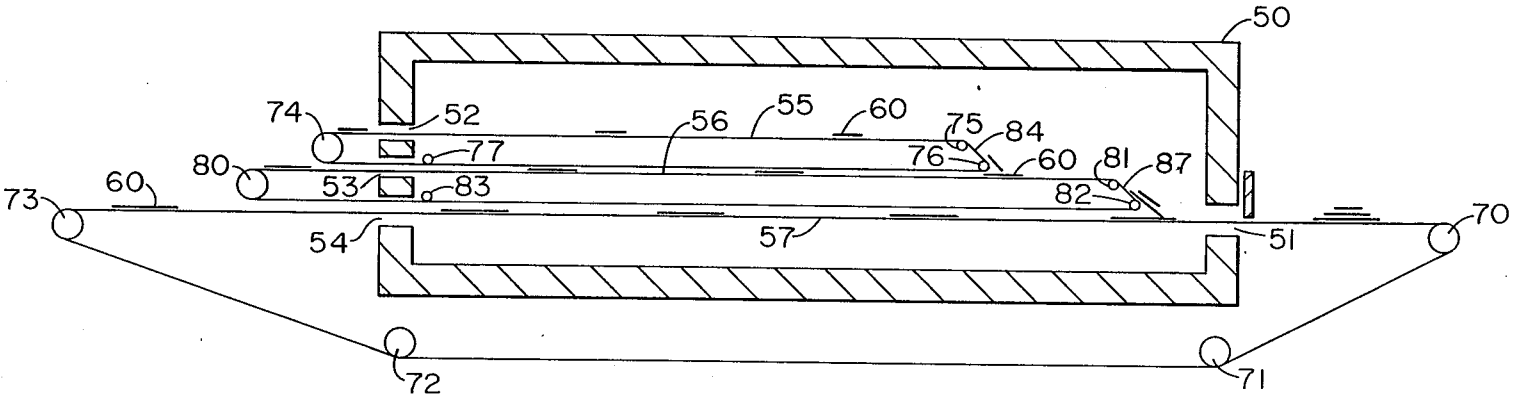
FIG. 4 is an elevational cross-section of the oven of FIG. 3 taken along lines 4—4.

In the embodiment of the oven 50 shown in FIGS. 3 and 4, a method is provided for stacking multiple sheets, one above the other, inside of an oven while still providing the necessary heating to raise the temperature of the sheets or blanks to 60 to a temperature sufficient to render the resin contained in the blank molten throughout. As shown therein, the conveyors 55, 56 and 57 are passed through the oven in the same horizontal mode, however, conveyors 56 and 55 terminate in the oven at a point in front of the exit port 51 of the oven while conveyor 57 passes entirely through the oven. Conveyor 57 is tracked by rollers 70, 71, 72, and 73. Conveyor 56 which is tracked by rollers 80, 81, 82, and 83 is provided with an inclined plane 87 at the end thereof. The conveyor 55, which is tracked by rollers 74, 75, 76, and 77 is provided with an inclined plane 84 at the end thereof and located above conveyor 56. In operation, the sheets 60 are placed on the conveyors 55, 56 and 57 and through the operation of the drive rollers 74, 70 and 73 and idle rolls shown, convey the sheets 60 through the oven from the entrance ports 52, 53 and 54 to the exit port 51.

The arrangement of the conveyors 55, 56 and 57 is such that sheets 60 are placed on the conveyor and the conveyor speeds are timed so that the sheets 60 contained on conveyor 57 pass under the inclined plane 87 at a point in time when a sheet 60 on conveyor 56 is riding down the inclined plane so that it is picked up by a sheet 60 conveyed on conveyor 57 as it passes under that inclined plane. Similarly, the sheets on conveyor 56 pass under the inclined plane 84 of the conveyor 55 at a point in time when the sheets 60 on the conveyor 55 are sliding down the inclined plane 84 so that those sheets are picked up by the sheets 60 on the conveyor 56. In this manner, three stacked sheets then are conveyed by conveyor 57 through port 51 to the outside of the oven 50. In this manner, it is possible to stack sheets for subsequent molding where stacked sheets are required for fill of a given molded part.

THE PREFERRED EMBODIMENT

Figure 5:
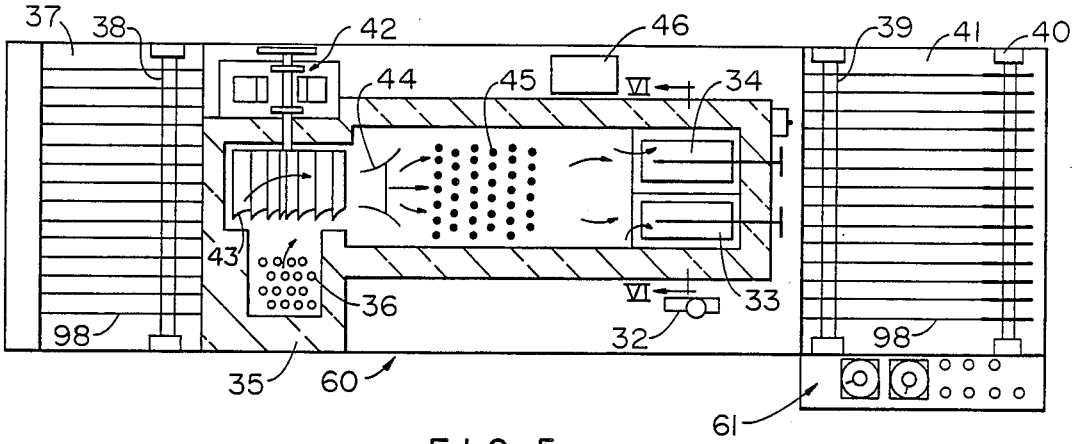
FIG. 5 is a top plan view, partially in section of the preferred embodiment of the invention.
Figure 6:
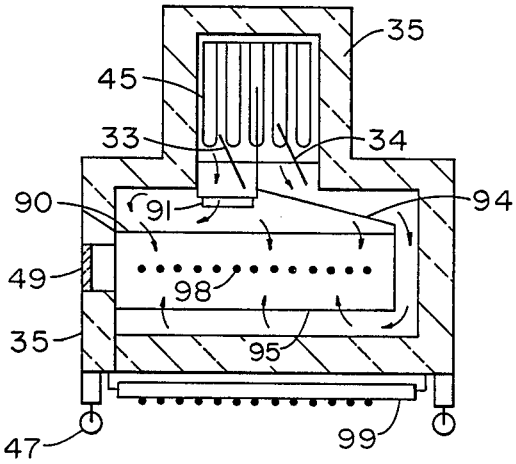
FIG. 6 is an end elevation partially in section taken along lines 5—5 of the oven shown in FIG. 5.

Turning now to FIGS. 5 and 6 which depict the preferred embodiment of the instant invention, there is shown therein an oven generally indicated at 60. The oven is provided with a loading zone on one side thereof, generally indicated at 37 and the loading zone is comprised of a plurality of cables 98 shown in section in FIG. 6 and on which the product rests in its transport through the oven 60. On the opposite side of the oven 60, is an unloading zone generally indicated at 41 which again, is composed of the same cables 98 from which the material treated by the oven 60 is removed after transport through the oven. In the area of loading zone 37 there is positioned an idler roller 38 over which the cables 98 ride as they pass into the oven 60. A similar idler roll 39 is provided at the unloading station 41. The cables 98 are driven by a drive roller 40 shown on the right hand side of FIG. 5 and drive roll 40 draws the cables 98 through the oven 60 and passes them over pulleys 92 and then downwardly and through the bottom portion of the oven to the return area or loading area 37 as a series of continuous belts. The oven 60 is provided with a blower 43 driven by blower motor 42 shown most clearly in FIG. 5. The return air is passed through a return air ports 36 which are associated with filters to filter out dust and debris picked up by the hot gases as they pass through the oven 60 and heat the materials being treated by the oven 60. Blower 43 takes gases coming from the return ports 36 and passes them across the heating elements 45 shown in both FIGS. 5 and 6. The heated gases are passed from the heaters 45 across the dampers 34 and 33 and then strike the diffuser 91 for the upper oven and the diffuser 94 which diffuses the gases to the lower oven. The gases from the upper oven pass through the upper diffuser plate 90 which is a metal plate having a plurality of holes, not shown, therethrough. The gases passing to the lower oven pass through a similar diffuser plate 95 located at the bottom of the oven so that the hot gases and diffused as they enter the work area and contact the work pieces carried on the cables 98 uniformly as shown more clearly in FIG. 6. An exhaust blower 32 is located in the oven and is utilized to vent gases from the oven when it is desired to relieve the circulating gases from the oven when desired. The box 46 shown in FIG. 5 represents a power supply for the oven which is utilized to activate drive rolls 40, blower 42 and other equipment associated with the oven. As can be seen in FIG. 6, the oven is provided with an access door 48 and a window 49 so that the operator can observe the workings of the oven as the work pieces proceed on the cables 98 through the oven. In the embodiment shown in FIG. 6, the oven is mounted on rollers 47 so that it can be moved from one location to another and is provided with a control panel 61 which can be utilized to control the gas feeds, blower operations, oven temperatures and the like in a manner conventional to convection oven operation.

Obvious modification to the invention may be made without departing from the spirit of the invention. Thus, for example, the conveyers of FIG. 4 can be arranged so that they terminate outside of the oven rather than inside as shown. While cable conveyors are preferred, the conveyor can have a foraminous surface as long as the sheets on the surface can be heated by the hot gases from below and above the conveyor surface. Further, in the embodiment shown in FIGS. 5 and 6, the oven can be modified to provide for a more than a one layer conveyor cable system such as shown in FIG. 6. Thus, a second row of cables 98 can be provided above or below the one shown in FIG. 6 by modifying the oven to accomplish this as shown in FIG. 4. In utilizing multiple cable systems, it will of course, be understood by those skilled in the art that the contents of the materials conveyed by the cables will be contacted by all of the gases circulating through the diffuser plates 90 and 95 respectively of FIG. 6 in the preferred embodiment.

Thus, while the invention has been described with respect to certain specific illustrated embodiments and examples, it is not intended that the invention be limited thereby except insofar as appears in the accompanying claims.

I claim:

1. An oven for heating and stacking sheets of fiber reinforced thermoplastic resin comprising:

an enclosed chamber;

at least two continuous conveyors in said chamber positioned one above the other;

the lower of said continuous conveyors traversing the oven from one end to the other;

the upper continuous conveyor terminating short of one end of said oven and the end of the lower continuous conveyor;

means to move said continuous conveyors in said oven from one end toward the opposite end, providing a sloped surface on the end of said upper continuous conveyor to thereby cause any sheets of material resting thereon to be forced in a downward direction at the end of the upper continuous conveyor;

said sloped surface of the upper continuous conveyor terminating at a point close to but above the surface of the lower continuous conveyor;

means to circulate gas through said oven downwardly and upwardly to all surfaces of said continuous conveyors to thereby heat all sheets carried by said continuous conveyors on both sides thereof to a desired temperature;

means to heat said gases to temperature sufficient to cause any thermoplastic resin sheet on the surfaces of said continuous conveyor to reach a molten state, and means to recirculate said heated gases continuously after contact with said surfaces while sheets are being conveyed through said enclosed chamber by passing them in sequence through a filter, said heating means, and said circulation means.

2. The apparatus of claim 1, including means to regulate the gas content of said furnace.

* * * * *